United States Patent [19]

Schnegg

[11] Patent Number: 4,724,179

[45] Date of Patent: Feb. 9, 1988

[54] WEFT INSERTION DRAPERY FABRICS

[75] Inventor: Julius R. Schnegg, Burlington, N.C.

[73] Assignee: Burlington Industries, Inc., Greensboro, N.C.

[21] Appl. No.: 661,072

[22] Filed: Oct. 15, 1984

[51] Int. Cl.[4] ..... B32B 3/08; B32B 5/08; B32B 5/12; D04B 21/14

[52] U.S. Cl. ..... 428/101; 66/84 A; 66/192; 156/78; 428/108; 428/109; 428/113; 428/193; 428/225; 428/304.4

[58] Field of Search ..... 66/192, 84 A; 428/101, 428/108, 109, 113, 193, 225, 304.4; 156/78

[56] References Cited

U.S. PATENT DOCUMENTS

| | | | |
|---|---|---|---|
| 2,118,108 | 5/1938 | Riley . | |
| 3,567,565 | 3/1971 | Jones et al. | 66/192 |
| 3,592,025 | 7/1971 | Sharpe | 66/192 |
| 3,910,072 | 10/1975 | Svoboda et al. . | |
| 4,026,129 | 5/1977 | Sternlieb . | |
| 4,181,514 | 1/1980 | Lefkowitz et al. . | |
| 4,192,160 | 3/1980 | Duhl et al. . | |
| 4,277,527 | 7/1981 | Duhl . | |
| 4,306,429 | 12/1981 | Warsop | 66/192 |
| 4,472,086 | 9/1984 | Leach | 66/192 |
| 4,518,640 | 5/1985 | Wilkens | 66/192 |
| 4,520,636 | 6/1985 | Schnegg | 66/192 |
| 4,608,290 | 8/1986 | Schnegg | 66/192 |
| 4,615,934 | 10/1986 | Ellison | 66/192 |

FOREIGN PATENT DOCUMENTS

| | | |
|---|---|---|
| 35593 | 11/1975 | Japan . |
| 15142 | 5/1976 | Japan . |
| 2047761 | 12/1980 | United Kingdom . |
| 2097829 | 11/1982 | United Kingdom . |
| 958541 | 9/1982 | U.S.S.R. . |

*Primary Examiner*—James C. Cannon
*Attorney, Agent, or Firm*—Nixon & Vanderhye P.C.

[57] ABSTRACT

An aesthetic dimensionally stable fabric suitable for use as drapery and upholstery or other decorative fabric is produced utilizing a weft inserted warp knitting machine having two or more stitching bars. A substrate that is dimensionally stable warp-wise (such as a 100 percent polyester nonwoven fabric that is dimensionally stable both warp-wise and weft-wise) is fed to the machine, as are weft yarns. The weft yarns are stitched in place by stitching thread fed to the stitching bars, the two main stitching bars moving in opposite directions in a basically zigzag form to create an aesthetically pleasing effect, but forming a pattern which is not dimensionally stable. However the end fabric produced is dimensionally stable as a result of the substrate properties. Stitching thread is preferably fed to a third stitching bar which is utilized to provide a dimensionally stable stitching pattern in the selvage areas of the fabric to facilitate finishing operations on the fabric. The selvage is subsequently removed. The decorative fabric produced may be foam backed, particularly for drapery use.

17 Claims, 9 Drawing Figures

Fig. 5
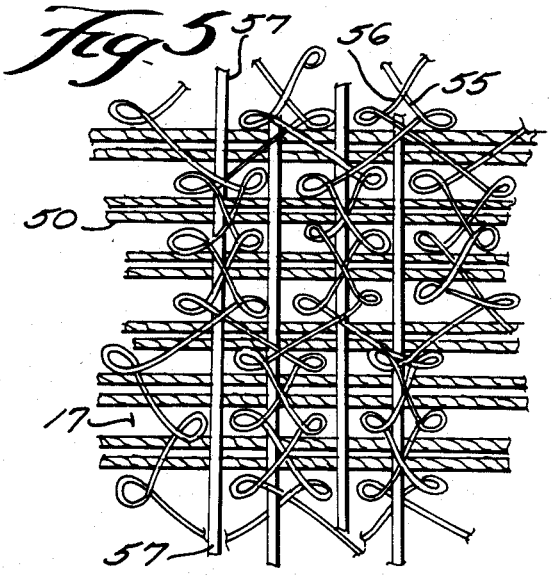
Fig. 6
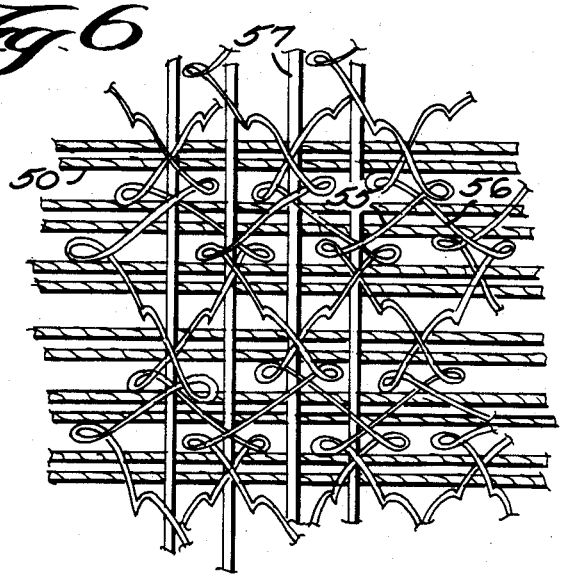
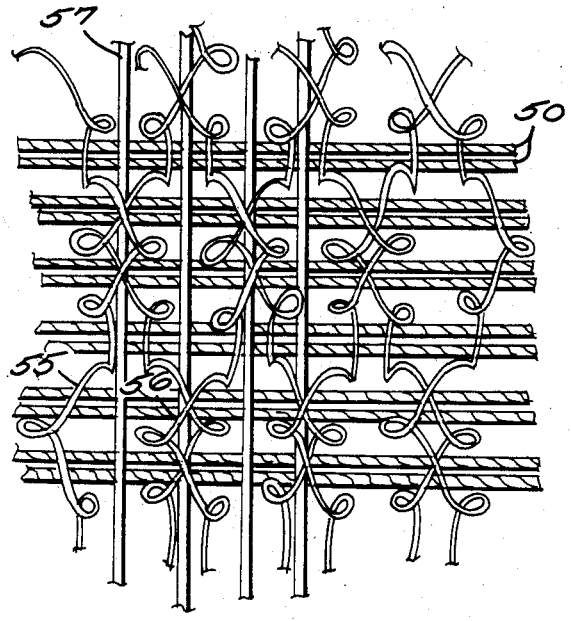
Fig. 7
Fig. 8
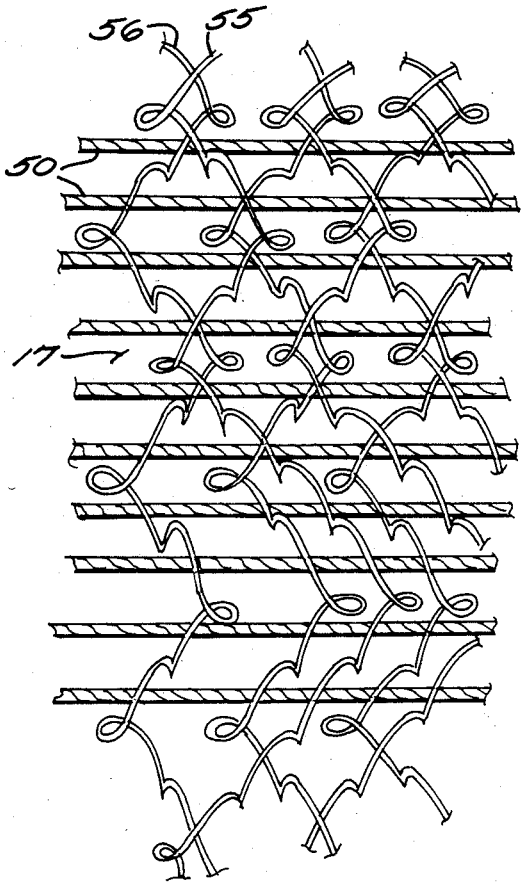

WEFT INSERTION DRAPERY FABRICS

BACKGROUND AND SUMMARY OF THE INVENTION

Weft insertion warp knitting machines are often utilized for the production of dimensionally stable fabrics, particularly for the production of draperies or upholstery. Typically, the weft yarns are held on a substrate utilizing a chain stitch or tricot stitch knitting construction. A single stitch forming guide bar is utilized to pattern the stitching to achieve the desired dimensionally stable chain or tricot stitch construction. The stitch construction is dimensionally stable because it ties the weft yarn down at regular intervals in a basically rectilinear way. While the product produced does thus have the desired feature of dimensional stability, often the fabric is stiff, and has poor aesthetic qualitities compared to similar woven fabrics.

For cost and efficiency reasons, conventional drapery fabrics are usually produced utilizing a 150 denier textured polyester stitching yarn, which is natural in color. The stitching yarn is highly visible in the final fabric (especially where medium to dark colored weft or decorative warp yarns are utilized), resulting in an undesirable appearance. Efforts have therefore been made to improve the appearance by covering the warp yarns with dyed yarn, utilizing irregular threading of the stitching yarn, etc. However such attempts have not been uniformly successful, and the final fabric produced typically is not entirely aesthetically acceptable.

According to the present invention, a dimensionally stable fabric is produced that is more asethetically pleasing. This is accomplished according to the present invention basically by utilizing two stitch forming guide bars in the weft inserted warp knitting machine, and moving the stitching bars in opposite directions in basically a zigzag form. While this stitch combination is dimensionally unstable (especially in fabric constructions with under 18 needles lined and/or under 18 courses per inch) since it does not tie the weft yarn down in regular mostly rectilinear intervals, and thus typically has not been thought suitable for drapery or upholstery fabric, in view of the fact that a dimensionally stable substrate is utilized (such as a 100 percent polyester nonwoven fabric), a dimensionally stable fabric does ensue. The appearance of the fabric is greatly improved vis-a-vis conventional drapery fabrics having chain stitch or tricot stitch configurations, and even though 150 denier textured polyester stitching yarn is also visible in the fabrics according to the invention, when knitted together with medium to dark colored weft yarns, it presents a less detrimental appearance because it becomes part of the design.

According to an exemplary method of the present invention, a decorative fabric is produced utilizing a weft inserted warp knitting machine having two or more stitching bars. The method comprises the following steps: (a) feeding a warp-wise stable substrate in a direction A to the knitting machine; (b) inserting weft yarn in a direction perpendicular to direction A utilizing the knitting machine; (c) feeding stitching thread to the stitching bars; (d) while stitching with the stitching bars, to cause the stitching thread to hold the weft yarn in place on the substrate, moving the stitching bars in opposite directions in a basically zigzag form to create an as such dimensionallly unstable, but aesthetic, pattern of stitching formation in the fabric produced; (e) finishing the fabric produced by steps (a)-(d); and (f) cutting the finished fabric to form desired fabric pieces.

It has been found, according to the present invention, that the stitching yarn must be very loose when fed to the stitching bars, otherwise the fabric is pulled in and an unacceptable product results. Therefore according to the present invention step (c) is practiced by utilizing feed rollers driven at a constant speed, or a like structure, for positive feeding of the stitching yarn to the stitching bars to make sure that there is not too much tension.

It has also been found according to the present invention that the fabric produced has a tendency to fold or curl at the edges as it comes off the knitting machine. This folding or curling creates problems during finishing operations since the fabric is pulled through the finishing structures for foam coating, or the application of other finishes, by exerting tension on the fabric. In order to ensure that the fabric can be finished properly, according to the invention it is desirable to provide a third stitching bar which stitches the selvage areas of the fabric (approximately a one inch selvage on either side of a central body portion of the fabric being provided) with a dimensionally stable stitching configuration, particularly chain stitching.

Thus, according to the invention an intermediate fabric, for the production of a decorative final fabric, is produced. The intermediate fabric according to the invention comprises: a warp-wise dimensionally stable substrate having a first face; weft yarns disposed on the first face of the substrate and extending parallel to each other; stitching thread for holding the weft yarns on the first face; the stitching thread comprising in a central body section of the fabric, between opposite ends thereof in a dimension basically perpendicular to the machine direction, stitching thread disposed in a dimensionally unstable, but aesthetic, configuration; and said stitching thread in selvage edge portions of the fabric, on opposite sides of the central body section thereof, stitching thread disposed in a dimensionally stable configuration. Decorative warp yarns also may be utilized, with the stitching holding the decorative warp yarns in place. The decorative warp yarns typically need not be applied in the selvage area.

Also according to the present invention, an upholstery or drapery or other dimensionally stable fabric is produced (i.e. a fabric that has sufficient dimensional stability) which also has excellent aesthetic properties compared to such fabrics typically produced on weft inserted warp knitting machines, Malimo machines, and the like. The fabric according to the invention comprises: a warp-wise stable substrate having a first face; weft yarns disposed on the first face of the substrate, and extending parallel to each other; and stitching thread in a dimensionally unstable, but aesthetic, pattern, holding the weft yarns in place on the substrate. Typically a foam backing will be provided on a second face of the fabric, opposite the first face, and decorative warp yarns will be utilized on the first face on top of the weft yarns.

It is the primary object of the present invention to provide a method for the production of, and to produce, a decorative fabric, useful for drapery and upholstery functions, which has good aesthetic properties. This and other objects of the invention will become clear from an inspection of the detailed description of the invention, and from the appended claims.

BRIEF DESCRIPTION OF THE DRAWINGS

FIGS. 5 through 9 are schematic representations of sections of various other embodiments of fabrics according to the invention, showing a wide variety of different dimensionally unstable, but aesthetic, stitching configuration.

DETAILED DESCRIPTION OF THE DRAWINGS

Figure 1:
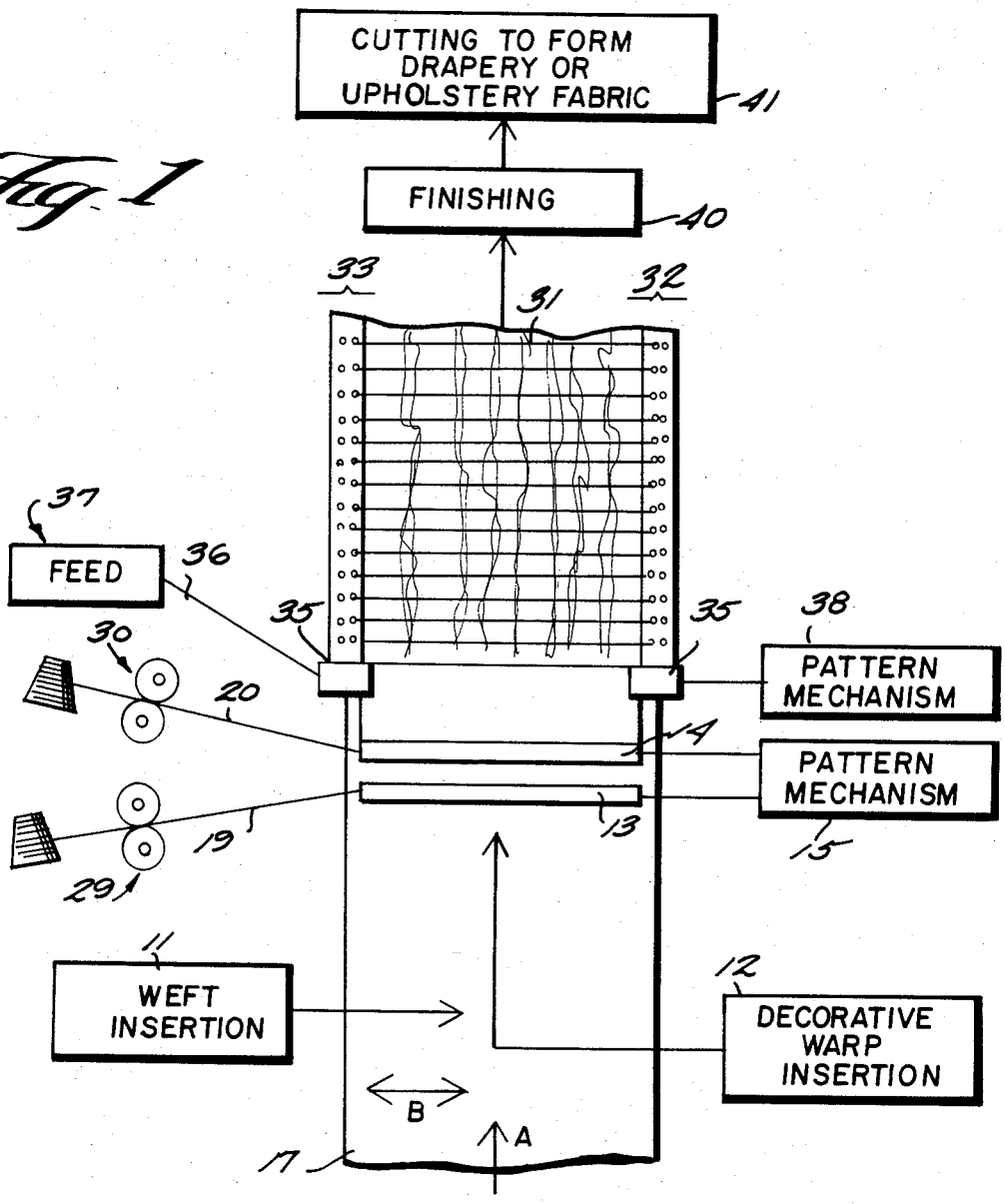
FIG. 1 is a schematic plan view illustrating exemplary apparatus utilized in the practice of an exemplary method according to the present invention.
Figure 9:
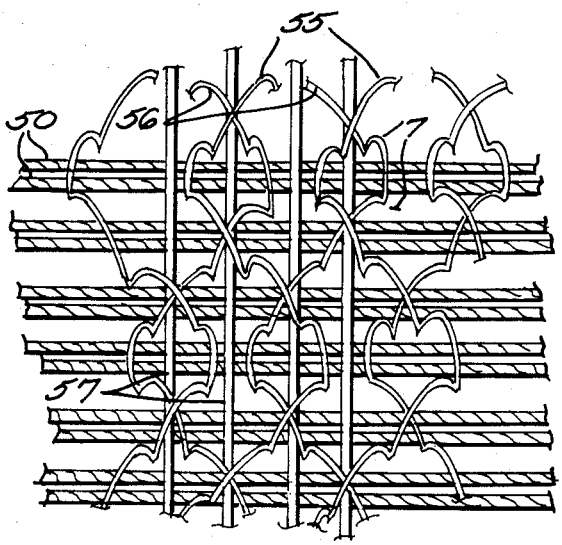

FIG. 1 schematically illustrates the apparatus and materials utilized in the practice of an exemplary method according to the present invention. The basic apparatus utilized in the practice of the method comprises a conventional weft inserted warp knitting machine. While a number of different types of such machines may be utilized, a particularly desirable machine is one commercially available from Karl Mayer Machinery Company of the Federal Republic of Germany, Model No. RS4 (6) MSU, such a machine having a substrate fabric feed, parallel weft insertion, pointed stitch-through needles, and decorative warp yarn introducing means. Typical weft inserted warp knit machines include either one or two stitching bars, and according to the present invention it is important to have two such bars, and preferably also to provide a third. The weft insertion structure 11 (schematically illustrated in FIG. 1), the decorative warp insertion means 12, the first and second stitching bars 13 and 14, and the pattern mechanism 15 are thus conventional components of a weft inserted warp knitting machine.

According to the method of the present invention, a substrate fabric 17 is fed in the machine direction A to the operative components of the warp knitting machine. The substrate 17 comprises a fabric which is dimensionally stable at least in the warp-wise direction. A wide variety of fabrics may be utilized, but one preferred fabric is a 100 percent polyester non-woven fabric from Scott Paper Company.

Weft yarns are inserted by the weft insertion means 11 so that they extend perpendicular to the direction A, and are fed with the substrate 17 to the stitching bars 13, 14. Suitable stitching yarn 19, 20, such as 150 denier textured polyester yarn, is fed to the stitching bars 13, 14. While stitching is being effected by the pointed stitch-through needles (not shown) of the knitting machine, the pattern mechanism 15 controls movement of the stitching bars 13, 14 to provide a desired stitching pattern. According to the present invention, while stitching is being practiced the pattern mechanism 15 moves the bars 13, 14 in opposite directins in basically a zigzag form. The stitch pattern that is created has an effect similar to a woven hobnail effect. The stitching pattern is not dimensionally stable since it does not tie down the weft yarns in a rectilinear line at regular intervals; however it is aesthetically pleasing.

Figure 2:
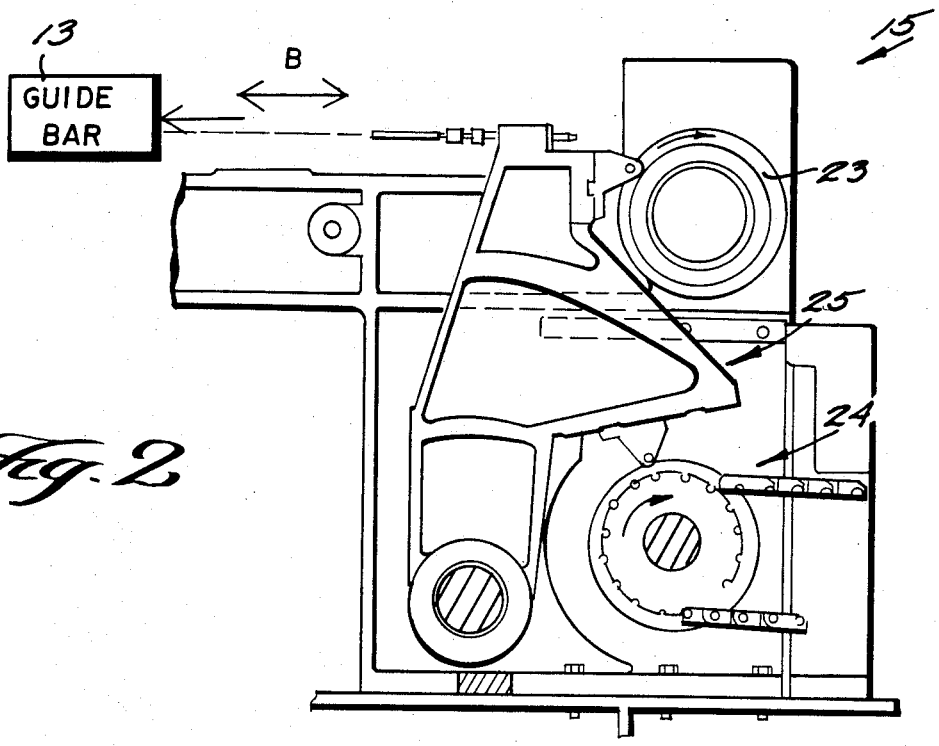
FIG. 2 is an end view of a typical conventional pattern mechanism utilizable with the stitch bars of the apparatus of FIG. 1.

An exemplary conventional structure that may be utilized as a pattern mechanism 15 is illustrated in FIG. 2. A pattern wheel 23, or pattern chain 24 acts through the follower mechanism 25 to effect reciprocal movement (in dimension B, essentially perpendicular to direction A) of the guide bar 13. The pattern wheel 23, pattern chain 24, and the like for the bars 13, 14 will be selected so as to achieve the desired stitch configuration.

It has been found according to the present invention that it is necessary to provide positive feed of the stitching threads 19, 20 to ensure that the tension of the stitching yarn is not too tight. If it is too tight, the fabric produced will pucker unacceptably. Positive feed is provided according to the invention by utilizing feed roller sets 29, 30 associated with stitching yarns 19, 20, respectively, which feed rollers 29, 30 are driven at a constant desired speed in a conventional manner (e.g. by an electric motor).

It has also been found according to the present invention that the fabric of the invention, while suitable as a drapery or upholstery fabric, is difficult to finish due to folding or curling of the selvage areas thereof. The selvages areas—the areas on either side of a central body portion 31 of the fabric in the dimension B—are denoted by reference numerals 32 and 33. Folding or curling of the selvage areas 32, 33 is prevented, according to the present invention, by utilizing a third stitching bar 35, which is fed with stitching yarn 36 from a conventional feed mechanism 37, and is reciprocated in dimension B utilizing a conventional pattern mechanism 38. The third stitching bar 35 is discontinuous over the central portion 31 of the fabric, but is provided at the selvage areas 32, 33, being approximately 9 wales (e.g. about one inch) in width at each selvage area 32, 33. The third stitching bar 35 is controlled by the pattern mechanism 38 so that conventional dimensionally stable stitches are provided in the selvage areas 32, 33, such as conventional chain stitches.

After production of the fabric including the central body portion 31, and selvage areas 32, 33, the fabric is passed to conventional finishing operations, and illustrated schematically by box 40 in FIG. 1. One typical finishing operation that may be employed is to provide a foam backing on the bottom of the substrate 17 (as viewed in FIG. 1), conventional foam backing techniques being described in U.S. Pat. Nos. 3,527,654 and 4,072,775. Ultimately, after finishing, the final fabric produced passes to a station 41 wherein the selvage areas 32, 33 are trimmed off, and the fabric is cut to the desired configuration for subsequent utilization of the fabric for the production of draperies, upholstery, or the like.

Figure 3:
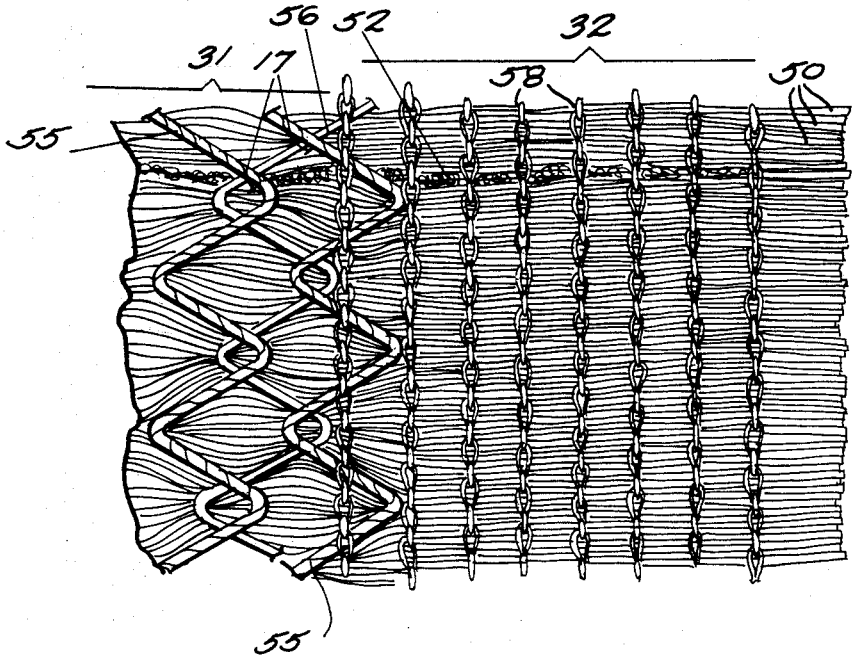
FIG. 3 is a plan view of an exemplary intermediate fabric produced according to the invention.
Figure 4:
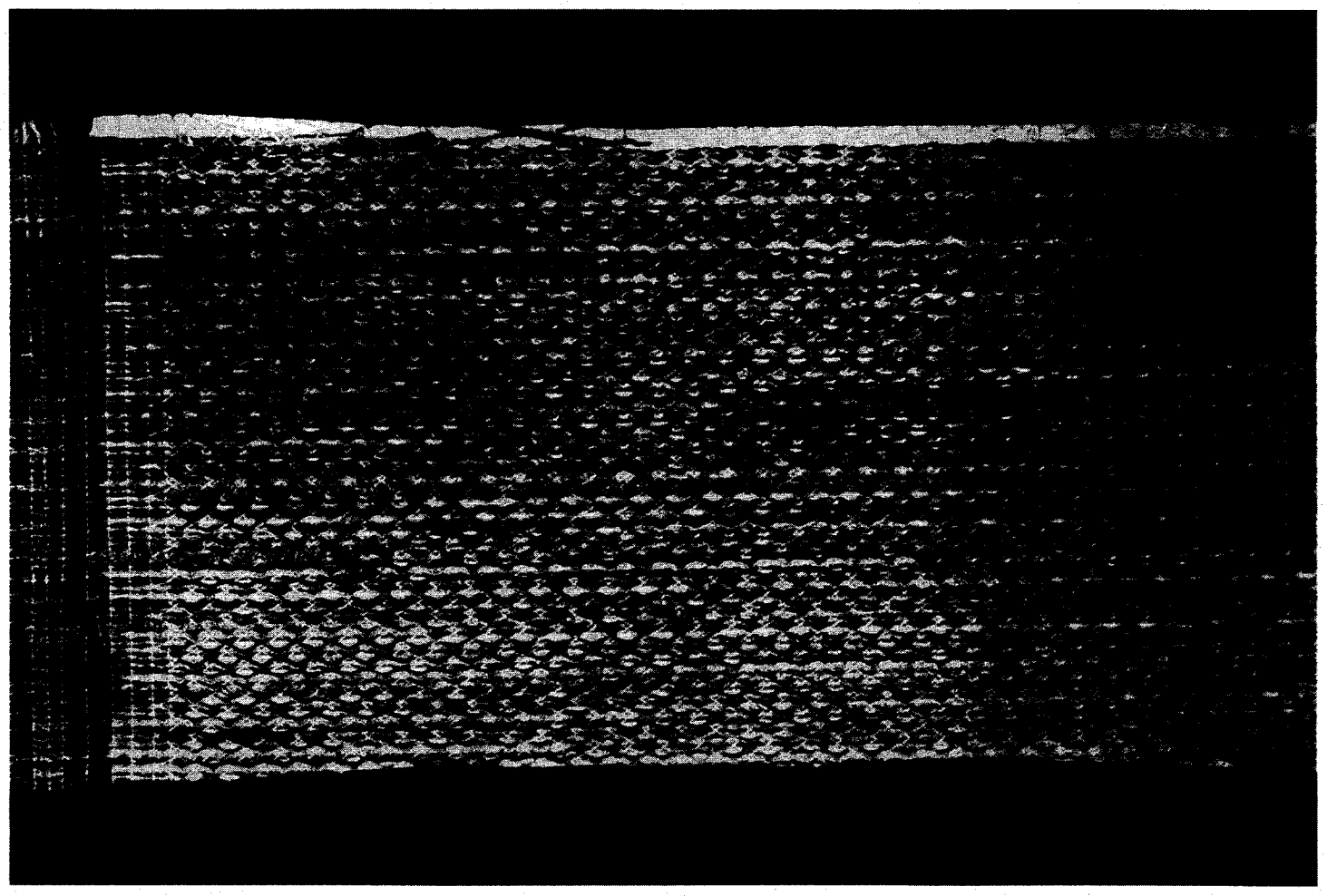
FIG. 4 is an enlarged photograph of section of an exemplary intermediate fabric according to the invention.

A section of a typical intermediate fabric produced according to the present invention is illustrated in FIGS. 3 and 4. Note the selvage area 32, which is approximately one inch wide. Note the weft yarn 50. Some of the weft yarns 50 have decorative effects formed therein, as indicated by reference number 52. In the embodiment of the fabric illustrated in FIGS. 3 and 4, a decorative warp yarn has not been provided, but of course optionally may be provided.

Note that in the main body portion 31 of the intermediate fabric section illustrated in FIGS. 3 and 4, the pattern of the stitching thread can be seen. It will be seen that the pattern is basically zigzag in configuration, and is dimensionally unstable (i.e. the weft yarns 50 are not tied down in a rectilinear line at regular intervals).

For clarity of illustration, at one area of the fabric central body portion 31, stitching threads 55 from the first stitching bar 13 have been highlighted in one manner, and stitching thread 56 from the secoond bar 14 has been highlighted in a different manner. Note that the substrate 17 is visible in the area between the weft yarns 50 and the stitches 55, 56.

Note that in the selvage area 32, stitching is provided by stitching threads 58, having a conventional chain stitch configuration. This allows the selvage 32 to maintain a flat configuration during the finishing operations.

Effective results can be achived by stitching with stitching threads at 10 courses per inch (or less), up to 24 courses per inch, or more. As one exemplary stitching bar pattern configuration that can be provided, a chain reading for the first bar 13 may be 1-0/1-2/2-3/2-1, and for the second bar 14 2-3/2-1/1-0/1-2//. For the selvage area, the third bar 35 reading would be 1-0/0-1//. The threading for bars 13, 14 is one in, one out, while the selvage is threaded solid one (1) inch (9 ends) on either side of the fabric body section 31. The stitch combinations do not have to be continuously the same after one repeat, but one or both of the bars 13, 14 can change their movement independently in order to create a different texture in the horizontal direction. FIGS. 5 through 9 show a variety of different stitching patterns that may be utilized, in each case stitches from the first bar 13 being indicated by reference numeral 55, and stitches from the second bar 14 by reference numeral 56, weft inserted yarns by reference numeral 50, and decorative warp yarns (where present) by reference numeral 57.

It will thus be seen that according to the present invention, a novel and advantageous method, final decorative fabric, and intermediate fabric used in the production of a decorative fabric, have been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and products.

What is claimed is:

1. A method of making a dimensionally stable decorative fabric utilizing a weft-inserted warp knitting machine having two stitching bars, comprising the steps of:

(a) feeding a warp-wise stable substrate in a direction A to the knitting machine;

(b) inserting weft yarn in a direction perpendicular to direction A utilizing the knitting machine;

(c) feeding stitching thread to the stitching bars;

(d) while stitching with the stitching bars, to cause the stitching thread to hold the weft yarn in place on the substrate, moving the stitching bars in opposite directions in a basically zigzag form to create a dimensionally unstable, but aesthetic, pattern of stitching thread with respect to the length of the weft yarn, in the fabric produced;

(e) finishing the fabric produced by steps (a)–(d); and (f) cutting the finished fabric to form desired fabric pieces.

2. A method as recited in claim 1 wherein step (e) is practiced by foam backing the substrate of the fabric so as to provide drapery or other decorative fabric.

3. A method as recited in claim 1 comprising the further step of, substantially simultaneously with steps (b)–(d), feeding decorative warp yarn into operative association with the substrate, utilizing the knitting machine, so that the stitching also holds the decorative warp yarn in place, the warp and weft yarns being perpendicular in rectilinear or curvilinear fashion to each other.

4. A method as recited in claim 1 wherein the substrate is a 100 percent polyester non-woven substrate dimensionally stable both warp-wise and weft-wise.

5. A method as recited in claim 1 wherein the stitching thread is thread having characteristics comparable to those of 150 denier textured polyester yarn.

6. A method as recited in claim 1 wherein step (c) is practiced by positively feeding the stitching thread to the stitching bars so as to ensure that the stitching yarn is not too tight.

7. A method as recited in claim 6 wherein step (c) is practiced utilizing feed rollers driven at constant speed.

8. A method as recited in claim 1 wherein step (f) is practiced by cutting off selvage edge portions of the fabric.

9. A method as recited in claim 8 wherein step (e) is practiced by foam backing the substrate of the fabric so as to provide drapery or other decorative fabric.

10. A method as recited in claim 8 wherein the substrate is a 100 percent polyester not woven substrate dimensionally stable both warp-wise and weft-wise.

11. A method as recited in claim 8 wherein the stitching thread is thread having characteristics comparable to those of 150 denier textured polyester yarn.

12. A method as recited in claim 8 comprising the further step of, substantially simultaneously with steps (b)–(d), feeding decorative warp yarn into operative association with the substrate, utilizing the knitting machine, so that the stitching also holds the decorative warp yarn in place, the warp and weft yarns being perpendicular in rectilinear or curvilinear fashion to each other.

13. A method as recited in claim 12 wherein step (e) is practiced by foam backing the substrate of the fabric so as to provide drapery or other decorative fabric.

14. An upholstery or drapery fabric comprising:

a warp-wise stable substrate having a first face;

weft yarns disposed on the first face of the substrate, and extending parallel to each other; and stitching threads holding the weft yarns on the substrate first face in a dimensionally unstable, but aesthetic, pattern with respect to the length of the yarns.

15. A fabric as recited in claim 14 further comprising decorative warp yarns disposed on the first face of the substrate and extending in lines substantially parallel to each other and perpendicular in rectilinear or curvilinear fashion to the weft lines, the stitching thread also holding the decorative warp yarns in place on the substrate.

16. A fabric a recited in claim 14 further comprising a foam backing disposed on a second face of the substrate, opposite the first face.

17. A fabric as recited in claim 14 wherein the substrate comprises a 100 percent polyester non-woven fabric dimensionally stable both warp-wise and weft-wise, and wherein the stitching thread has the properties of 150 denier textured polyester stitching thread.

* * * * *